US009943162B1

(12) United States Patent
Samelian

(10) Patent No.: US 9,943,162 B1
(45) Date of Patent: Apr. 17, 2018

(54) CAMP AND RESCUE BAG

(71) Applicant: John Samelian, Mendota Heights, MN (US)

(72) Inventor: John Samelian, Mendota Heights, MN (US)

( * ) Notice: Subject to any disclaimer, the term of this patent is extended or adjusted under 35 U.S.C. 154(b) by 0 days.

(21) Appl. No.: 15/530,628

(22) Filed: Feb. 10, 2017

Related U.S. Application Data

(60) Provisional application No. 62/388,923, filed on Feb. 12, 2016.

(51) Int. Cl.

| | |
|---|---|
| ***A45F 4/02*** | (2006.01) |
| ***B63C 9/26*** | (2006.01) |
| ***A45F 3/14*** | (2006.01) |
| ***A47G 9/10*** | (2006.01) |
| *A45F 4/00* | (2006.01) |

(52) U.S. Cl.
CPC ..... *A45F 4/02* (2013.01); *A45F 3/14* (2013.01); *A47G 9/1045* (2013.01); *B63C 9/26* (2013.01); *A45F 2003/142* (2013.01); *A45F 2004/006* (2013.01)

(58) Field of Classification Search
CPC .. B63C 9/00; B63C 9/082; B63C 9/22; B63C 9/26; B63C 9/28
USPC ..... 441/80, 84
See application file for complete search history.

(56) References Cited

U.S. PATENT DOCUMENTS

| | | | | |
|---|---|---|---|---|
| 4,713,033 A * | 12/1987 | Cameron | B63C 9/26 | 441/84 |
| 6,257,942 B1 * | 7/2001 | Groover | B63C 9/26 | 441/84 |
| 6,679,743 B1 * | 1/2004 | Gerber | B63C 9/26 | 441/80 |
| 6,800,007 B2 * | 10/2004 | Calkin | B63C 9/26 | 441/80 |
| 7,347,757 B1 * | 3/2008 | Lanthier | B63C 9/26 | 441/80 |

* cited by examiner

*Primary Examiner* — Lars A Olson
(74) *Attorney, Agent, or Firm* — Johnson & Phung LLC

(57) ABSTRACT

A multipurpose rapid response rescue device comprising a throwable multipurpose camp and rescue bag that in one mode can be used as multi modal rapid response rescue device, which can be employed instantly to rescue a person in distress and in other modes can be used as a water pail or pillow with the camp and rescue bag containing a throwing weight and a rope therein with a one end of the rope secured to the camp and rescue bag so that when the camp and rescue bag is thrown to a remote area or person in distress and the other end of the rope is hand held the rope unfurls from the camp and rescue bag to provide for retrieval of the camp and rescue bag or an object secured thereto.

20 Claims, 7 Drawing Sheets

CAMP AND RESCUE BAG

CROSS REFERENCE TO RELATED APPLICATIONS

This application claims priority of provisional application Ser. No. 63/388,923 filed Feb. 12, 2016.

STATEMENT REGARDING FEDERALLY SPONSORED RESEARCH OR DEVELOPMENT

None

REFERENCE TO A MICROFICHE APPENDIX

None

BACKGROUND OF THE INVENTION

A person who enjoys the outdoors may backpack or canoe into a remote wilderness area and then camp overnight for one or more days. Wilderness camping requires that the person be self-sufficient since supplies are not readily available in the wilderness. In order to be self-sufficient the person must carry those articles necessary to sustain him or her during the camping outing. However, the number of articles that a person can comfortably carry into the wilderness area is typically limited by space as well as the carrying capacity of the camper. With weight limitations and space at a premium a camper may forego taking certain articles that provide comfort as well as other articles that provide convenience. In some cases a person may even forego taking articles for emergency use in favor of another type of article. In still other instances, a person may want to have a device available for both comfort and rescue. The invention described herein aids the person in selecting the articles to include in an outing without having to sacrifice safety or convenience as well as providing a compact rescue device that can be used in multiple instances and multiple locations.

SUMMARY OF THE INVENTION

A multipurpose rapid response rescue device comprising a throwable multipurpose camp and rescue bag that in one mode can be used as multi modal rapid response rescue device, which can be employed instantly, and in another mode as a convenient camp device that can be a water pail, a pillow, a head rest or a hoist for securing a food bag away from bears. To store food items away from a bear the camp and rescue bag, which contains a throwing weight and a rope stored therein, has a one end of the rope secured to the camp and rescue bag so that when the camp and rescue bag is thrown over a limb while a thrower holds onto a free end of the rope the rope stored within the camp and rescue bag unfurls therefrom to provide a hoist for retrieval of the camp and rescue bag. An object such as a food bag can be quickly secured thereto by a connector carried on the exterior of the camp and rescue bag while other items may be attached to the straps on the bag as the rope is used to hoist the camp and rescue bag into the air and high enough so a bear cannot reach it.

DESCRIPTION OF THE PREFERRED EMBODIMENT

Figure 1:
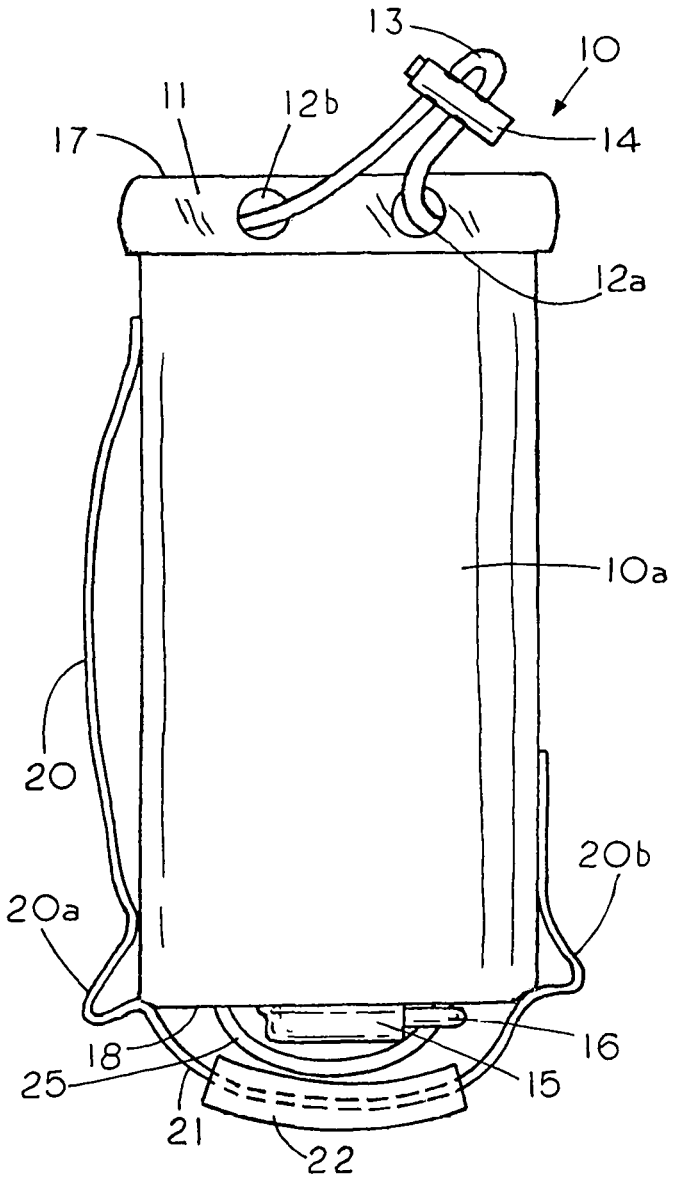
FIG. 1 is a front view of my hand throwable camp and rescue bag.
Figure 2:
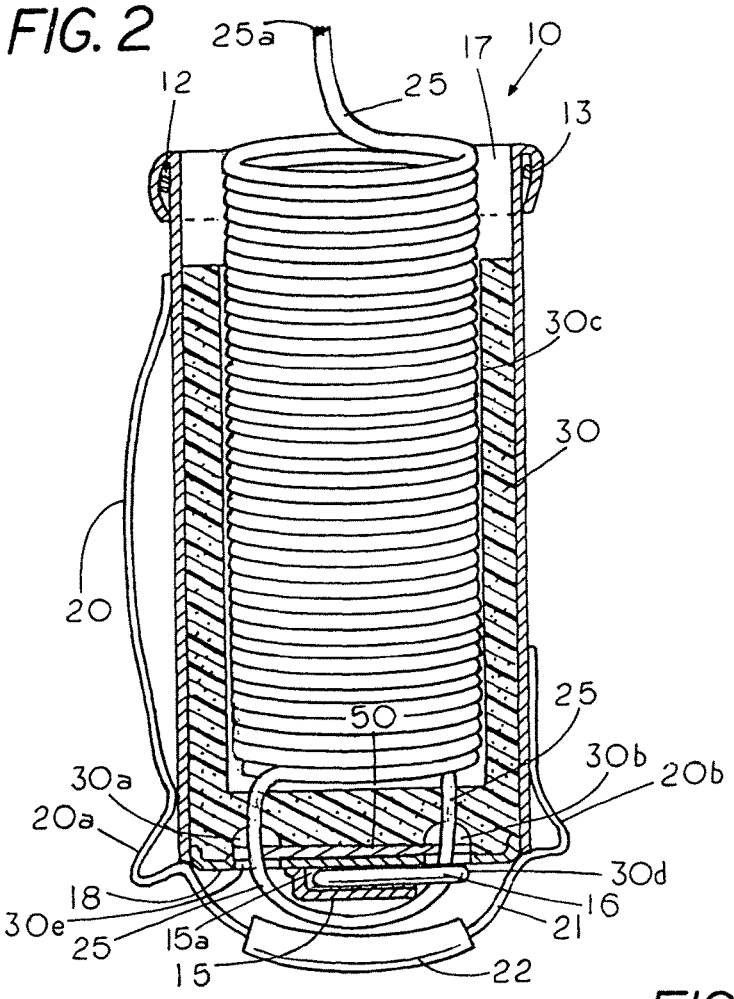
FIG. 2 is a sectional view of the camp and rescue bag of FIG. 1.

FIG. 1 is a front view of my hand throwable camp and rescue bag 10 comprising a cylindrical shaped flexible container made from a durable cloth or cloth like material 10*a*, which may be coated with a waterproofing material or the like and FIG. 2 is a sectional view of camp and rescue bag 10. The camp and rescue bag includes an open top 17 with a top circumferential band 11 having a circumferential passage 12 therein that contains a cord 13, which exits through eye 12*a* and eye 12*b*. A cord stopper 14, which is known in the art, typically contains an internal compression spring member with and end member that can frictionally engage the cord to prevent the cord 13 from sliding therethough when the cord stopper is engaged with cord 13. Typically, one squeezes the cord stopper 14 to release the cord stopper from the cord. In operation one pulls on cord 13 while holding bag 10 to squeeze close the open top bag 10. One then slides the cord stopper 14 against the band 11 and along the cord to bring the camp and rescue bag 10 to a closed condition. While a cord stopper 14 is shown the invention may be used with or without a cord stopper without departing from the spirit and scope of the invention. For example, a cord with free ends that can be tied together to temporarily close the camp and rescue bag.

In this example bag 10 includes an elongated side-carrying strap 20, which is attached to the side of the bag, as well as a bottom-carrying strap 21, which is attached to the bottom of the bag, with either strap allowing the user to carry the bag 10 and contents therein from place to place. A carrying sleeve 22 extends around the strap 21 to provide a hand cushion for the user. Strap 21 also includes a loop 20*a* and a loop 20*b* that can be used to attach articles to the camp and rescue bag.

Located on the bottom or closed end 18 of camp and rescue bag 10 is a first rope hole 30*d* and a second rope hole 30*e* for the rope 25 to extend from inside the camp and rescue bag to the outside of the camp and rescue bag. Camp and rescue bag includes an externally padded pocket 15 that includes a passively carried throwing weight 16, which is frictionally held in space 15*a* therein through the elasticity of the pocket so that the throwing weight remains therein as the rescue bag is thrown to a remote location. In this example, the throwing weight 16 in the externally padded pocket 15 is a connector such as a metal carabineer, which can be hand opened or closed. The use of the carabineer as the throwing weight allows a user to impart throwing momentum to the rescue bag 10 while at the same time providing a quick attachment link once the camp and rescue bag arrives at its destination. The externally padded pocket 15 has the benefit of securing a heavy article therein to aid in throwing the lighter weigh camp and rescue bag to a person in distress. A feature of the invention is that the padded pocket 15 prevents one from getting injured should the thrown camp and rescue bag accidently hit a person. A rope 25, which is located in a chamber 30*c* in camp and rescue bag 10 has a free end 25*a* extending out from the top of the bag and an attached end extending through a first bottom opening 30*e* in bag bottom 18 and a loop in the carabineer 16 and back through a second bottom opening 30*d* in bag bottom 18. Preferably rope 25 comprise a water flotation rope so the when the camp and rescue bag 10 is used in a water rescue mode the rope floats in the water to facilitate sighting and grasping the rope by a person in distress. As described the camp and rescue bag 10 comprises a rapid response article since throwing the camp and rescue bag instantly causes the rope 25 to begin to unfurl from the camp and rescue bag 10 thus instantly providing a retrieval line to a person receiving the thrown camp and rescue bag 10.

Figure 7:
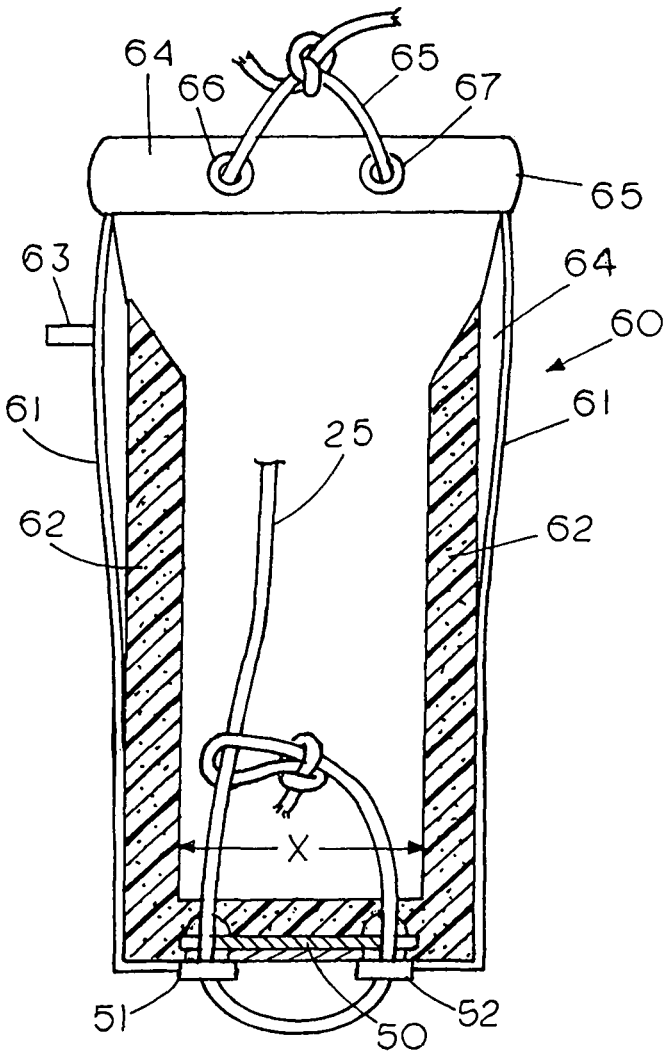
FIG. 7 shows an alternative embodiment of the camp and rescue bag with grommets to provide wear reinforcement.

FIG. 2 shows the camp and rescue bag 10 in section revealing a top circumferential passage 12 and a cord 13 extending therethough. In this example a cylindrical flotation liner 30 with a circular bottom forms a flotation liner that extends around the interior of the closed end of the camp and rescue bag 10 with the rope 25 coiled and stored in a chamber 30*c* in bag 10. A free end 25*a* of the rope extends out the open end 17 of the bag while the opposite end of the rope 25 is secured to the camp and rescue bag 10 by looping the rope 25 through the opening 30*e* and the opening 30*d* in the bottom 18 of camp and rescue bag 10. While rope 25 is shown coiled it may also be stuffed into the bag. In either case the rope 25 is loosely confined within the bag 10 so that the rope can easily unfurl from compartment 30*c* as the camp and rescue bag 10 is thrown to a remote area. If desired a grommet may be placed around bag openings 30*a* and 30*b* in the camp and rescue bag 10 to limit wear and tear on the fabric 10*c*. FIG. 7 illustrate an example of how a grommet 51 and grommet 52 can be placed in a camp and rescue bag to provide wear reinforcement. A feature of the camp and rescue bag 10 is that it can be used store food away from bears during a camping outing. To do so the camp and rescue bag 10 is thrown over a tree limb with the camp and rescue bag 10 falling to the ground while the trailing rope 25 remains over the tree limb. The camper then secures the handle 21 or the carabineer 16 to a food bag and pulls on rope 25 to hoist the food bag off the ground to a height where the bear cannot reach the food bag. The rope free end 25*a* can then be secured to another tree to maintain the food bag out of reach of a curious or hungry bear.

Figure 2A:
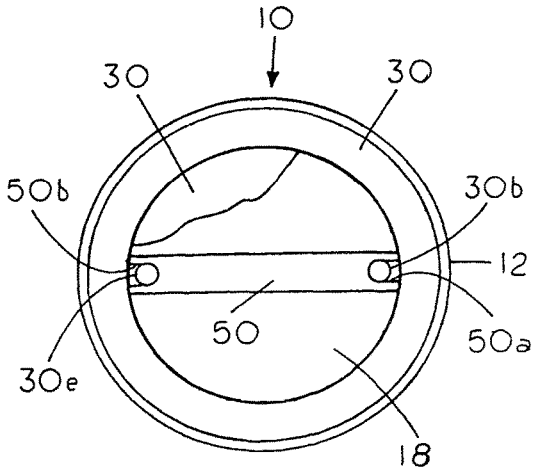
FIG. 2A is a top view of the camp and rescue bag with a portion of the liner removed to reveal a stiffener or rope spacer located therein.
Figure 2C:
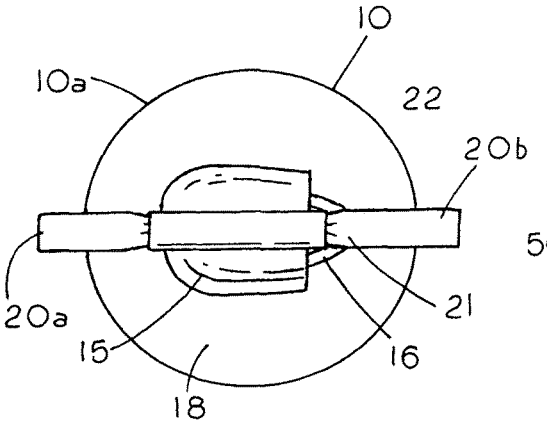
FIG. 2C is a bottom view of the camp and rescue bag shown a carabineer secured in a padded elastic pocket on the bottom of the camp and rescue bag.
Figure 2B:
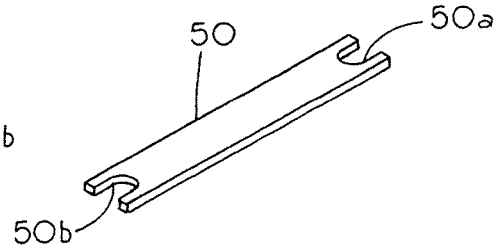
FIG. 2B is an isolated view of the stiffener or rope spacer located in the bottom of the camp and rescue bag.

FIG. 2A is a top view of the camp and rescue bag 30 without a rope therein and with a portion of liner 30 removed to reveal a rigid stiffener and rope spacer 50 therein while FIG. 2B is an isolated view of the rigid stiffener and rope spacer 50. The stiffener and rope spacer 50 contains a first rope cradling end 50*a* having a U-shape end for cradling one portion of rope therein and a second rope cradling end 50*b* also having a U-shape end for cradling a further portion of rope therein. In operation cradling end 50*b* and cradling end 50*a* provide reinforcement for the bottom 18 of camp and rescue bag 10 when the rope 25 extends through hole 30*e* and a hole 30*d* in camp and rescue hag 10 since a force on the rope therein is prevented from collapsing the bottom 18 of the camp and rescue bag.

Figure 3:
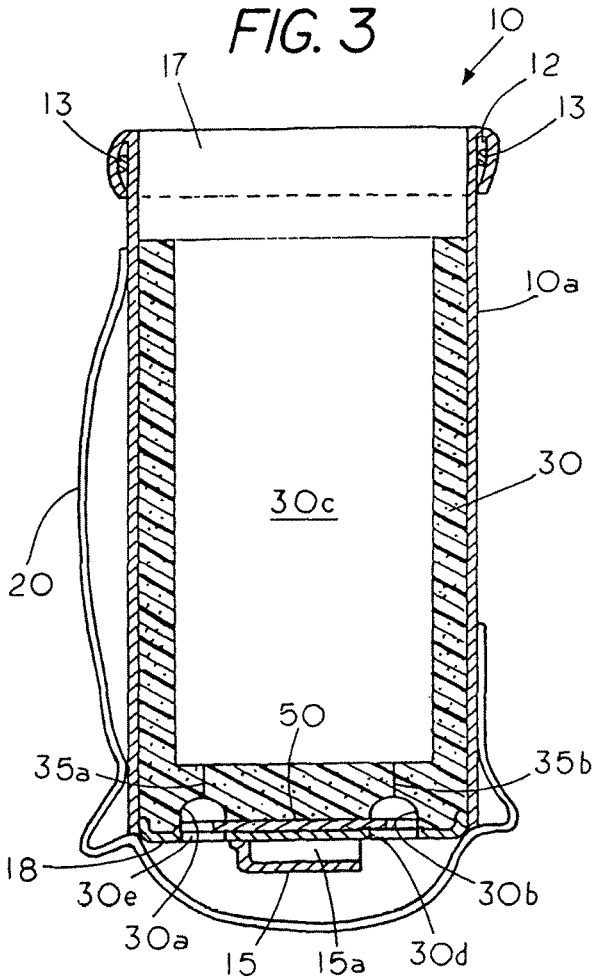
FIG. 3 is a sectional view of the camp and rescue bag of FIG. 1 without the rope attached.

FIG. 3 is a sectional view of the camp and rescue bag 10 showing the internal rope compartment 30*c* without the rope and the weight compartment 15*a* without a throwing weight located therein. A feature of the buoyant liner 30 located on the inside of camp and rescue bag 10 is that it provides water flotation in the event camp and rescue bag lands in a body of water. For example, a flotation material such as closed cell foam or the like is preferred since it does not absorb water although other flotation materials may be used without departing from the spirit and scope of the invention. In addition, the flotation of liner 30 can also provides flotation assistance to a person during a water rescue when a person grasps the camp and rescue bag 10. In other cases one may want to use the flotation provide by the liner 30 in camp and rescue bag 10 as a swimming assist when the bag 10 contains a flotation rope since both the rope and the rescue bag provide flotation. A further feature of the invention as shown in FIG. 3 is that the liner 30 comprise a resilient material that includes a first self sealing rope slit 35*a* and a second self sealing rope slit 35*b* that closes or self heals to form a water tight seal when the rope 25 is removed therefrom to thereby allow camp and rescue bag 10 to be used for example as a water pail for carrying water to put out a camp fire or bailing water from a boat.

Figure 4:
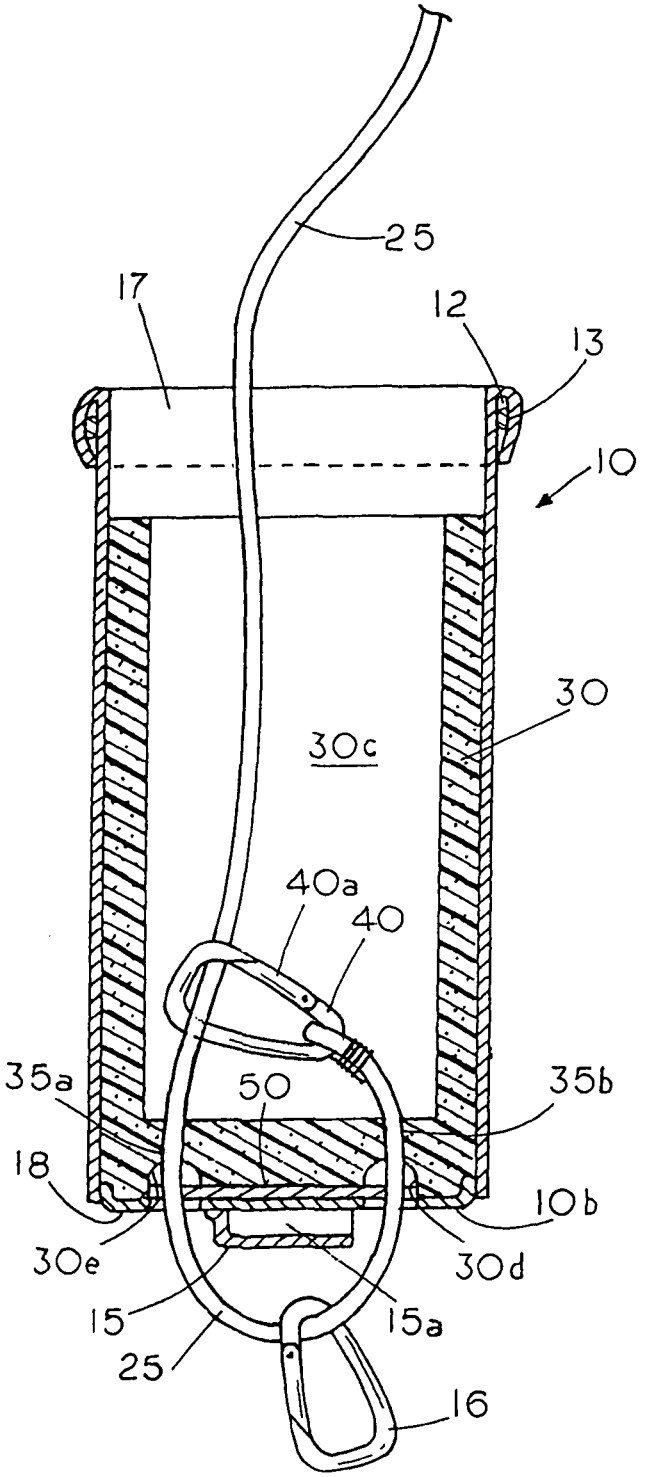
FIG. 4 is a sectional view of the camp and rescue bag of FIG. 1 after being thrown showing the location of a carbineer on the inside and a carbineer on the outside of the rescue device.

FIG. 4 is a sectional view of the camp and rescue bag 10 of FIG. 1 after the bag has been thrown and the rope 25 unfurled from compartment 30*c*. Note, the location of a carbineer 40 on the inside and a carbineer 16 on the outside of the bag 10. In this example the first carabineer 40 having a pivoting extension 40*a* to open and close the carabineer is located on one end of rope 25 with the carabineer 40 extending around the rope 25 to form a rope loop to affix the rope 25 to the camp and rescue bag 10. The second carabineer 16, which is located on the loop in rope 25, which is outside of the camp and rescue bag 10 can be used to attach to an article. In one example, such as retrieval or rescue the carabineer 16 may be quickly hooked to an article through the opening and closing latch 16*a* on the carabineer 16 allowing an article to be retrieved through pulling on rope 25. In some instance one may want to use a large mouth carabineer that can be attached directly to an item and in other instances one can form a second external double rope loop as shown in FIG. 5 that can be placed around a larger article or person for the purpose of engaging and pulling the article or person to safety.

Figure 5:
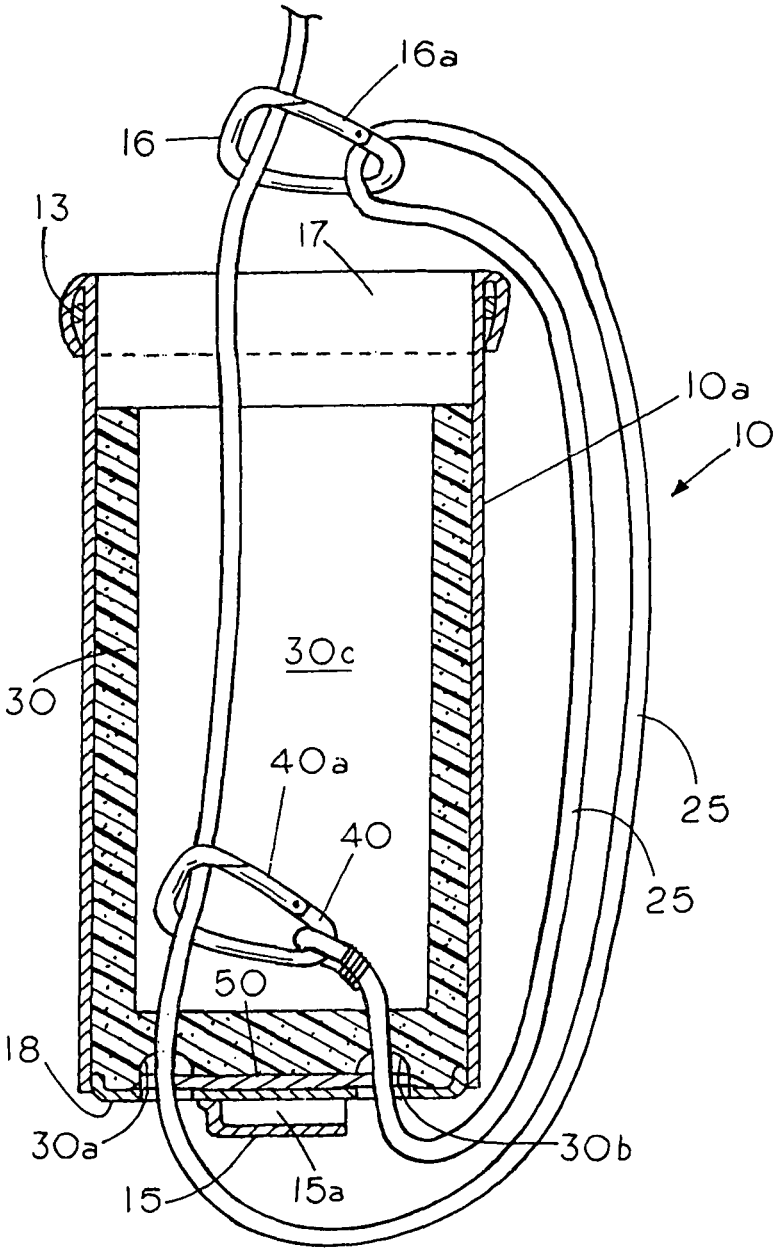
FIG. 5 shows the camp and rescue bag of FIG. 4 with a rescue rope looped for attachment to a person or article.

FIG. 5 shows the camp and rescue device of FIG. 4 with rescue rope 25 double looped for attachment to a person or article. In this example the carabineer 16 is attached to line 25 to form a double rope loop that creates a rope cinch that can be placed around an article to secure the rope to the article as one pulls on the free end of rope 25. This is useful feature if the articles is a large article and does not have an attachment point since the loop can be expanded using the slack in the rope.

Figure 6:
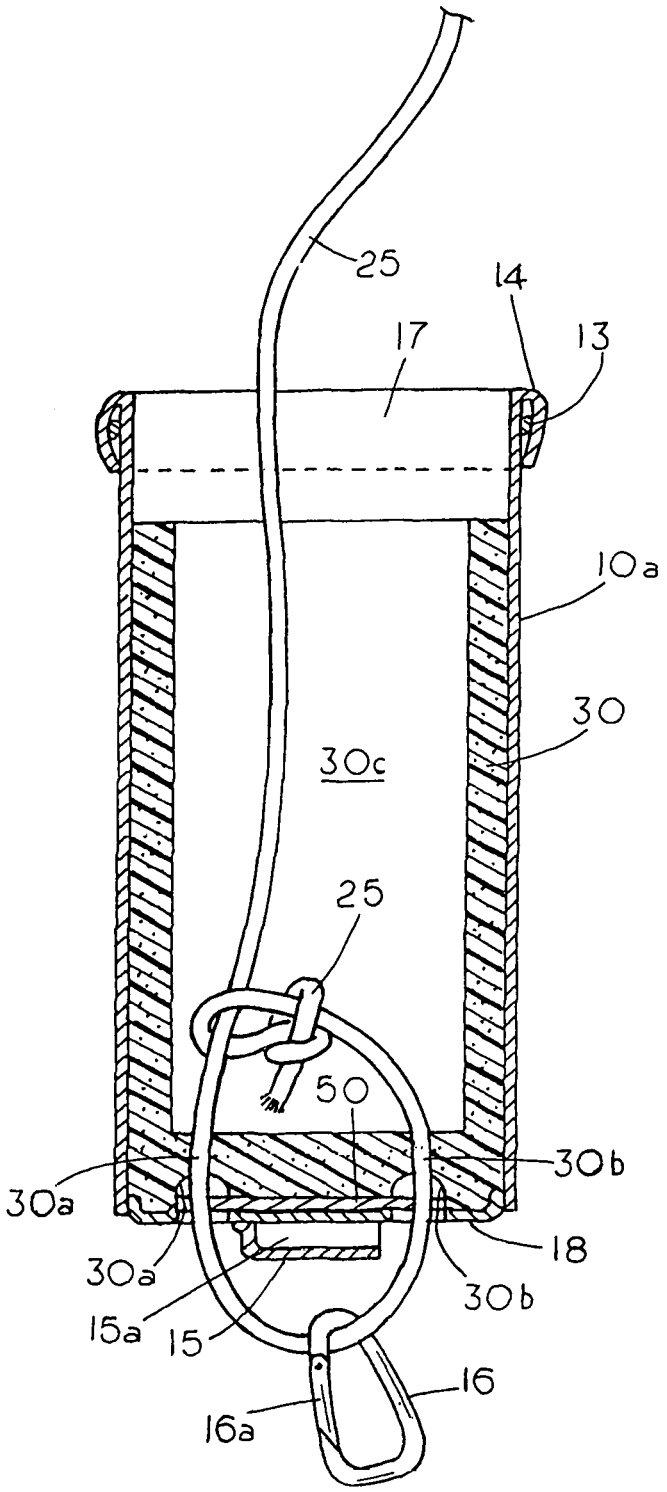
FIG. 6 shows the camp and rescue bag of FIG. 1 with an outside carbineer and an internal end rope loop engaging the throw rope.

FIG. 6 shows another example of the camp and rescue bag 10 with the outside carbineer 16 and an internal end rope of rope 25 tied in a loop around the throw rope 25. This example uses only one connector 16, which is mounted in a padded elastic pocket 15 on the outside of camp and rescue bag 10 to aid in throwing the camp and rescues device 10 to a person in distress.

As described herein the camp and rescue bag 10 comprises both a rapid rescue device as well as a useful camping article. A further feature of the camp and rescue bag 10 is that it is a compact article that can easily be carried during an outing while at the same time providing safety, comfort and convenience. While the rescue bag is shown in a cylindrical configuration in some instance one may want the camp and rescue bag 10 to have a different shape or a wider opening 17 than the bottom of the bag in order to quickly insert a rope into chamber 30*c* in camp and rescue bag 10, which makes for quicker and easier replacement of the rope 25 if a second throw of the camp and rescue bag is necessary to reach a person in distress. Also in some instances one may want to use the web straps 20 and 21 to form a cinch loop that can be used in rescue operations. In the example shown the throwing weight is preferably a carabineer 16 resiliently held in a padded pocket on the bottom end of the camp and rescue bag with the carabineer having a density greater than the rope or the flexible container to provide a throwing weight in the camp and rescue bag. Other types of connectors and weights may be used without departing from the spirit and scope of the invention.

FIG. 7 shows an example of another embodiment of a camp and rescue bag 60 that includes an inflatable annular air bladder 61 having an annular chamber 62 therein with a stem 63 for air inflation of the bladder 61 to provide additional flotation assistance to the camp and rescue bag 60 when the camp and rescue bag 60 is used in the rescue mode. In this example the liner 62 forms a rope chamber 60*c* that extends upward to hold the camp and rescue bag 60 in the open condition with the chamber 60*c* formed therein having a top width y, which is greater than the width x of the lower portion of the camp and rescue bag 60. The feature of a wider top or mouth to the camp and rescue bag 60 is useful in those instances when one may have to rethrow the camp and rescue bag. That is, the wider mouth on the camp and rescue bag 60 makes it easier for one to quickly replace the rope 25 in the camp and rescue bag 60 for a second throw of the camp and rescue bag 60 in the event the first throw did not reach the intended target. In this example a cord 65 extends through a cord chamber in circumferential band 69 and out through passages 66 and 67 where the ends of cord 65 can be secured to each other. In one example a spring like bungee cord or a stiff cord may be used to provide an outward force to maintain the mouth or top of the camp and rescue bag in an open condition to facilitate a faster replacement of the rope in the compartment therein.

I claim:

1. A hand throwable camp and rescue bag comprising:

a flexible container having a top opening;

an adjustable closure secured to a top end of the flexible container for closing the top opening;

a carrying strap secured said camp and rescue bag;

a rope located in a chamber of said flexible container with a first end extendable out the top opening in the container and a second end secured to the camp and rescue bag bag;

a carabineer attached to a bottom end of the camp and rescue bag with the carabineer having a density greater than the rope or the flexible container to provide a throwing weight in the camp and rescue bag; and a carabineer pocket on the closed end of said camp and rescue bag with the carabineer pocket holding the carabineer therein as the camp and rescue bag is thrown.

2. The hand throwable camp and rescue bag of claim 1 including;

a stiffener engaging the rope to maintain portions of the rope in a spaced condition as the rope passes through a bottom of the camp and rescue bag; and a buoyant liner in said flexible container having sufficient buoyancy to float the camp and rescue bag if the camp and rescue bag lands in a body of water.

3. The hand throwable camp and rescue bag of claim 1 including a set of self sealing rope ports on a closed end of the camp and rescue bag to allow the camp and rescue bag to be used as a pail.

4. The hand throwable camp and rescue bag of claim 1 wherein the carrying strap is secured to a side of the camp and rescue bag or the end of the camp or rescue bag or both to form a loop for attaching an article thereto.

5. The hand throwable camp and rescue bag of claim 1 wherein the adjustable closure comprises a string closure extending around the top end of the camp and rescue bag for securing the camp and rescue bag in a closed condition.

6. The hand throwable camp and rescue bag of claim 1 wherein the rope comprises a water floatation rope located in the flexible container with the rope loosely stored therein so that when the camp and rescue bag is thrown the rope unfurls from the camp and rescue bag with a grommet located in the camp and rescue bag to limit wear on the camp and rescue bag.

7. The hand throwable camp and rescue bag of claim 1 wherein the adjustable closure includes a cord with a cord lock for maintaining the camp and rescue bag in a closed condition.

8. The hand throwable camp and rescue bag of claim 1 wherein the rope in the flexible container and the flexible container combine to form a pillow to comfortably support a person.

9. The hand throwable camp and rescue bag of claim 1 wherein the carabineer pocket includes an exterior cushion to prevent injury if the throwable camp and rescue bag with the carbineer therein strikes a person.

10. The hand throwable camp and rescue bag of claim 1 wherein the rope is detachable from the camp and rescue bag to enable attachment of the rope to an article to be retrieved and the camp and rescue bag includes an air inflatable liner for providing additional buoyancy.

11. The hand throwable camp and rescue bag of claim 1 wherein the rope extends in and out of a closed end of the container and through the carabineer including a second carabineer on the rope for engaging or disengaging the rope.

12. The hand throwable camp and rescue bag of claim 1 wherein the adjustable closure includes a cord with a flexible cord holder thereon.

13. A hand throwable camp and rescue bag comprising;

an elongated container having an open end and a closed end;

an annular inflatable bladder;

a liner in said container with said liner forming a rope chamber having at least one rope port on the closed end;

a rope located in said container with a one end of the rope secured to the container to allow the rope to unfurl from the container when a free end of the rope is held as the camp and rescue bag is thrown to a remote location.

14. The hand throwable camp and rescue bag of claim 13 wherein the container includes a cord closure on the open end for retaining the rope in the container when the container is used as a head rest.

15. The hand throwable camp and rescue bag of claim 14 including a ballast attached to said camp and rescue bag in a padded pocket to provide a throwing weight for the hand throwable camp and rescue bag that inhibits or prevent injury to a person who may be accidently hit by the camp and rescue bag.

16. The hand throwable camp and rescue bag of claim 15 wherein the liner comprising a water flotation liner that extends around the inside of the container to provide water floatation to the camp and rescue bag.

17. The hand throwable camp and rescue bag of claim 16 wherein the ballast in the camp and rescue bag comprise a metal carabineer to enable the camp and rescue bag to be thrown to a remote location as the rope in the camp and rescue bag unfurls during flight of the rescue bag.

18. The hand throwable camp and rescue bag of claim 16 wherein the rope comprise a water flotation rope stuffed within the camp and rescue bag with a one end of the rope secured to the camp and rescue bag so that when the free end is held as the camp and rescue bag is thrown the water flotation rope unfurls therefrom.

19. The hand throwable camp and rescue bag of claim 16 wherein a one end of the rope in the camp and rescue bag is secured to the camp and rescue bag with the rope extending through a self sealing port in the camp and rescue bag with the self sealing port inhibiting water leakage there through when a chamber in the camp and rescue bag is used as a water carrier.

20. The hand throwable camp and rescue bag of claim 13 wherein a material of the rescue bag comprises a flexible water repellant fabric and a mouth of the bag is larger than a bottom of the liner in the camp and rescue bag.

* * * * *